US005966786A

United States Patent [19]

Bowling

[11] Patent Number: 5,966,786

[45] Date of Patent: Oct. 19, 1999

[54] LATCH MECHANISM FOR A CASKET

[75] Inventor: Donald W. Bowling, Osgood, Ind.

[73] Assignee: Batesville Services, Inc., Batesville, Ind.

[21] Appl. No.: 08/994,722

[22] Filed: Dec. 19, 1997

[51] Int. Cl.[6] ..... A61G 17/00

[52] U.S. Cl. ..... 27/2; 27/DIG. 1; 27/17; 292/302

[58] Field of Search ..... 292/300, 302; 27/2, DIG. 1, 14, 16, 17; 403/324, 375, 381, 353

[56] References Cited

U.S. PATENT DOCUMENTS

| | | | |
|---|---|---|---|
| 71,468 | 11/1867 | Earley | 292/300 |
| 302,159 | 7/1884 | Reynolds . | |
| 320,834 | 6/1885 | Argerbright . | |
| 350,155 | 10/1886 | Reynolds . | |
| 379,715 | 3/1888 | Noble . | |
| 386,691 | 7/1888 | Conklin . | |
| 776,319 | 11/1904 | Greensides . | |
| 954,276 | 4/1910 | Frazier . | |
| 1,044,498 | 11/1912 | Comee | 27/DIG. 1 X |
| 1,323,488 | 2/1919 | Peckens | 292/300 |
| 1,533,017 | 4/1925 | Leidy . | |
| 1,620,544 | 3/1927 | Greive | 27/17 X |
| 1,689,150 | 10/1928 | Mensch . | |
| 2,088,320 | 7/1937 | De Vries | 292/302 X |
| 2,128,001 | 8/1938 | Kotchaver et al. . | |
| 2,284,921 | 6/1942 | Purkiss . | |
| 2,323,674 | 7/1943 | Purkiss | 27/DIG. 1 X |
| 2,417,756 | 3/1947 | Hillenbrand . | |
| 2,587,355 | 2/1952 | McEwan . | |
| 2,621,064 | 12/1952 | Ware . | |
| 2,863,690 | 12/1958 | Lewin . | |
| 3,021,163 | 2/1962 | Hoffmann . | |
| 3,521,920 | 7/1970 | Morand . | |
| 4,576,307 | 3/1986 | Frydenberg . | |
| 5,060,993 | 10/1991 | Maier . | |
| 5,716,154 | 2/1998 | Miller et al. | 403/353 X |

*Primary Examiner*—Terry Lee Melius
*Assistant Examiner*—William L. Miller
*Attorney, Agent, or Firm*—Wood, Herron & Evans, L.L.P.

[57] ABSTRACT

A latch mechanism (10) for burial or cremation caskets (12) includes a stud (22) which is press-fit in the lower edge (18) of the casket lid (16), and a latch plate (24) which resides within a transverse recess (40) in an upstanding wall (20) of the casket shell (14). The latch plate includes an elongated keyhole-shaped slot (44) which is accessible to the stud via a vertical hole (46) in the upper edge (21) of the shell wall. The slot has a wide portion (48) which allows the stud to pass through the latch plate, and a narrow portion (50) which is narrower than the distal end (52) of the stud. The stud includes a necked-down portion (54) which is narrower than the narrow portion of the slot. The latch plate is slidable within the recess from a first position in which the stud resides within the wide portion of the slot to a second position in which the necked-down portion of the stud resides within the narrow portion of the slot. The latch mechanism parts are easily fabricated out of a combustible material such as plastic, and are secured within the casket without the use of metal fasteners.

12 Claims, 2 Drawing Sheets

LATCH MECHANISM FOR A CASKET

FIELD OF THE INVENTION

The present invention relates to latch mechanisms for caskets and, more particularly, to latch mechanisms for wooden caskets which may be used either as burial caskets or cremation caskets.

BACKGROUND OF THE INVENTION

Caskets which may be used either for burial or cremation typically are made of wood, and include a shell or body portion and a cap or lid portion, the two portions fitting closely together edge-to-edge when the casket is closed. In order to assure that the lid is firmly held closed against the shell, such caskets usually include one or more latch or locking mechanisms.

In the cremation industry, it is desirable to eliminate to as great an extent as possible the use of non-combustible components in the manufacture of a cremation casket. However, most currently available latch or locking mechanisms for caskets are made of metal, which is not combusted during the cremation process. Furthermore, many prior latch mechanisms include components which must be secured in place using metal fasteners such as screws. Additionally, many prior latch mechanisms are relatively complicated, having a multiplicity of parts.

SUMMARY OF THE INVENTION

Accordingly, the invention provides a latch mechanism consisting of only two parts each of which is readily made from a combustible material such as plastic, and each of which is securable to the casket without the use of metal fasteners. To these ends, the latch mechanism includes a stud which in use is press-fit or otherwise secured within a vertical hole formed in the lower edge of the casket lid, with a portion of the stud projecting downward from the lid lower edge and terminating at a distal end. The distal end of the stud has a first width dimension, and the stud includes a necked-down portion of a second smaller width dimension spaced inward (i.e., toward the lid lower edge) of the distal end. The latch further includes a latch plate which in use is secured within a transverse recess in an upstanding wall of the casket shell. The latch plate includes an elongated keyhole-shaped hole or slot which in use is accessible to the stud through a vertical hole extending from the shell upper edge downward into the transverse recess. The slot has a wide portion sized to permit the distal end of the stud to pass vertically through the latch plate, and a narrow portion which has a width smaller than the first width dimension of the stud's distal end but large enough to accommodate the necked-down portion of the stud. The latch plate in use is slidable within the transverse recess from a first position in which the stud resides within the wide portion of the slot to a second position in which the necked-down portion resides within the narrow portion of the slot. With the latch plate in the first position, the lid is closed against the shell, the stud passing through the wide portion of the slot. Once the shell is closed, the latch plate is slid into the second position, causing the necked-down portion of the stud to engage the narrow portion of the slot. Because the distal end of the stud is wider than the narrow portion of the slot, the stud cannot be withdrawn from the latch plate. Thus, opening of the lid is prevented when the latch members are so engaged.

According to a preferred embodiment of the invention, the latch plate includes a main body portion through which the slot extends, a flange portion which is connected to the main body portion and extends beyond the edges of the main body portion, and a handle portion connected to the flange portion. During installation of the latch mechanism, the main body portion of the latch plate is inserted into the transverse recess in the shell wall from outside the casket, until the flange portion abuts the outer surface of the shell wall. The transverse recess is wider than the width of the main body portion, so that the latch plate can slide within the recess. The flange portion rides along the outer surface of the shell wall when the latch plate is slid to engage or disengage the mechanism.

According to a further preferred embodiment of the invention, the transverse recess extends all the way through the shell wall to the interior of the casket, and the latch plate is retained within the transverse recess by a pair of posts projecting from the main body portion of the latch plate opposite the handle portion. The posts are thus accessible from the inside of the casket. A pair of plastic washers are snapped onto enlarged heads of the posts to prevent the latch plate from being withdrawn from the recess.

There is thus provided a casket locking mechanism which is readily constructed from plastic or other combustible material, which does not require any metal fasteners, and which includes a small number of parts and is therefore simple to manufacture and install.

BRIEF DESCRIPTION OF THE DRAWINGS

The accompanying drawings, which are incorporated in and constitute a part of this specification, illustrate an embodiment of the invention and, together with the general description of the invention given above and the detailed description given below, serve to explain the principles of the invention.

DETAILED DESCRIPTION OF THE DRAWINGS

Figure 1:
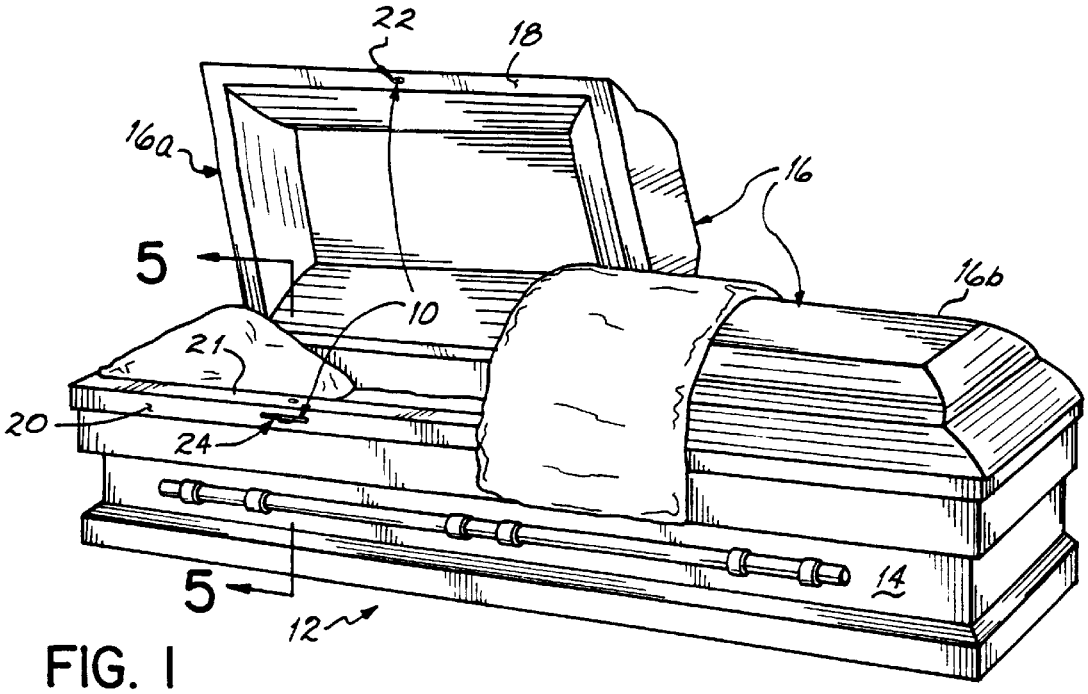
FIG. 1 is a perspective view of a casket showing the general location of a latch mechanism of the present invention.
Figure 2:
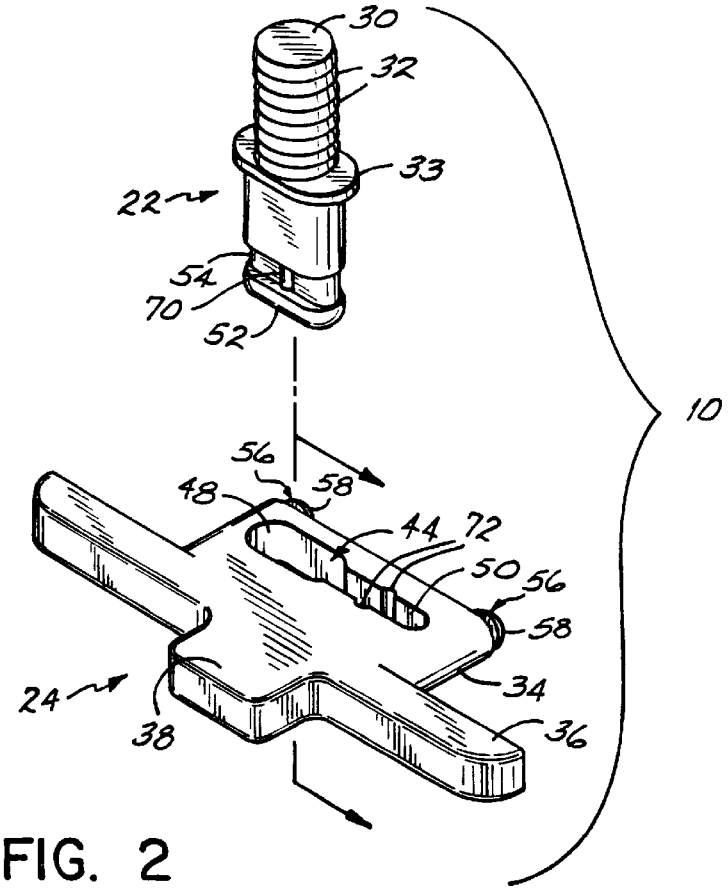
FIG. 2 is an exploded perspective view of a latch mechanism according to the principles of the present invention.
Figure 3:
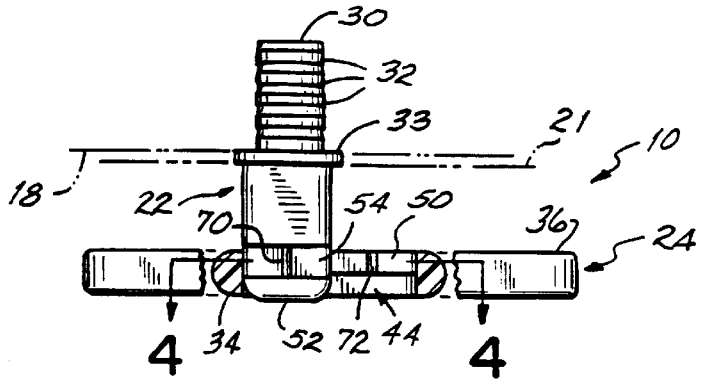
FIG. 3 is a front elevational view, partly in cross-section, of the latch mechanism of FIG. 2, showing the stud engaged in the slot of the latch plate.

With reference to FIG. 1, a latch mechanism 10 is shown installed in a casket 12. The casket 12 includes a body portion or shell 14 and a cap portion or lid 16. The lid 16 may be a single unit which covers the entire shell 14 and pivotally opens as a unit, but more commonly comprises a pair of sections 16*a* and 16*b* which can be opened and closed independently of one another. The latch mechanism 10 is shown in connection with the lid section 16*a*, but it will be appreciated that a second latch mechanism may be used for latching the lid section 16*b*.

The lid 16*a* includes a lower edge 18, and the shell 14 includes an upstanding wall 20 which terminates at an upper edge 21. The lower edge 18 and upper edge 21 abut against one another when the lid 16*a* is closed. The latch mechanism 10 includes a stud 22 which is installed in the lower edge 18 of lid 16*a*, and a latch plate 24 which is installed in the upstanding wall 20. The stud 22 and latch plate 24 cooperate in a manner described below to retain the lid 16*a* in a closed position.

Figure 5:
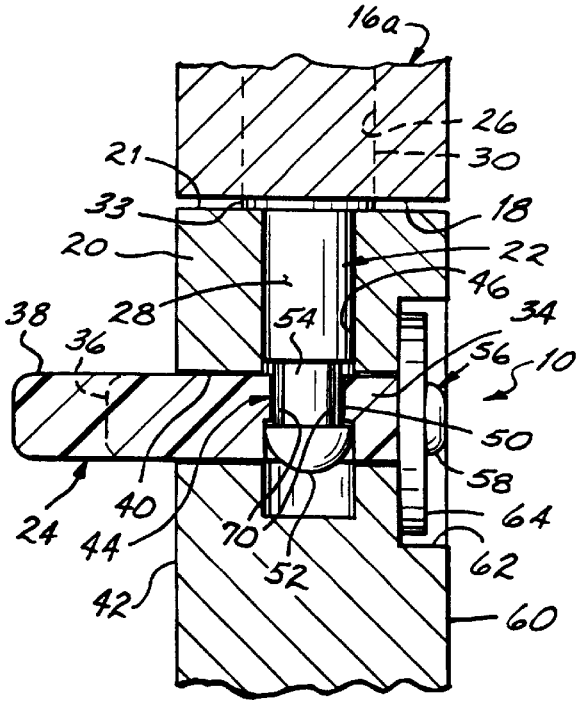
FIG. 5 is a cross-sectional view taken along line 5—5 of FIG. 1, but with the lid closed and the stud engaged in the latch plate.

With reference to FIG. 5, the stud 22 is retained within a hole 26 in the lid lower edge 18 with a portion 28 of the stud 22 projecting from the lower edge 18. The portion 30 of stud 22 which is retained within hole 26 is preferably press-fit in the hole 26, and therefore includes a plurality of circumferentially extending ribs 32 which engage the inner surface of the hole 26 to prevent inadvertent withdrawal of the stud 22. Alternatively or additionally, adhesive may be used for securing the stud 22 within the hole 26. The stud 22 includes a flange 33 between the projecting portion 28 and the portion 30 which resides within the hole 26. The flange 33 abuts the lid lower edge 18 to properly locate the stud 22 vertically.

The latch plate 24 includes a main body portion 34, a flange portion 36 connected to the main body portion 34 and extending beyond the edges of the main body portion 34, and a handle portion 38 connected to the flange portion 36. The latch plate 24 is installed in the shell wall 20 by inserting the main body portion 34 into a transverse recess 40 formed in the outer surface 42 of the wall 20 with the flange portion 36 abutting the outer surface 42. The main body portion 34 includes an elongated keyhole-shaped hole or slot 44. The slot 44 is accessible through a hole 46 in the shell upper edge 21. The hole 46 extends downward into the transverse recess 40 in the shell wall. The recess 40 and the hole 46 are positioned such that when the lid 16*a* is closed, the projecting portion 28 of stud 22 is inserted into the hole 46 with the projecting portion 34 extending into the transverse recess 40.

Figure 4A:
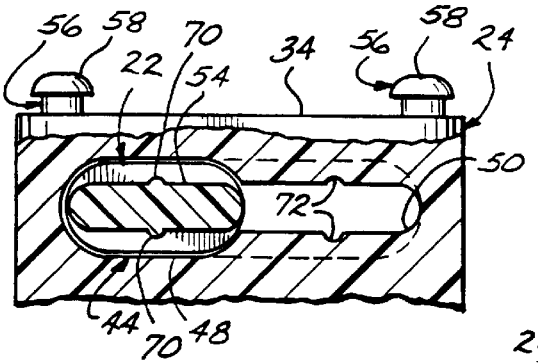
FIG. 4A is a cross-sectional view taken on line 4—4 of FIG. 3, showing the latch plate in a position permitting disengagement of the stud.

The slot 44 in latch plate 24 includes a wide portion 48 and a narrow portion 50. The recess 40 is dimensioned and located with respect to the hole 46 so that when the lid 16*a* is closed, the latch plate 24 may be slid within the recess 40 from a first position in which the wide portion 48 is vertically aligned with the stud 22 to a second position in which the narrow portion 50 is vertically aligned with the stud 22. The handle portion 38 facilitates grasping of the latch plate 24 for the purpose of sliding the latch plate 24 from one position to the other. The projecting portion 28 of stud 22 has a distal end 52 whose width is slightly less than the width of the wide portion 48 of slot 44 so that the distal end 52 can pass through the wide portion 48 when the lid 16*a* is closed with the latch plate in the first position, as illustrated in FIG. 4A. The projecting portion 28 further includes a necked-down portion 54 spaced inward of the distal end 52, the width of the necked-down portion being slightly less than the width of the narrow portion 50 of slot 44. The necked-down portion 54 is located along the length of stud 22 so that when the lid 16*a* is closed, the necked-down portion 54 is horizontally aligned with the narrow portion 50 of slot 44. The width of the narrow portion 50 of slot 44 is less than the width of the stud distal end 52, so that the distal end 52 cannot pass vertically through the narrow portion 50.

Figure 4B:
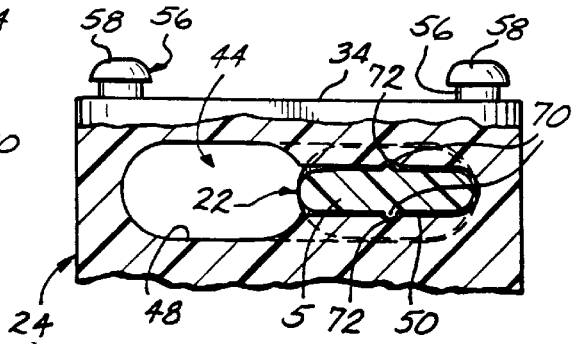
FIG. 4B is a cross-sectional view similar to FIG. 4A, but showing the latch plate in a position preventing disengagement of the stud.

Thus, with the lid 16*a* in a closed position, the latch plate 24 is slid from the first position as shown in FIG. 4A, to the second position as shown in FIG. 4B. As a result, the necked-down portion 54 of stud 22 slidably engages the narrow portion 50 of slot 44. The lid 16*a* is then prevented from being opened by virtue of the distal end 52 of stud 22 being too wide to pass through the narrow portion 50 of slot 44. The lid 16*a* is thereby securely retained in a closed position.

The latch plate 24 includes a pair of posts 56 for connecting a pair of washers so as to retain the latch plate within the recess and prevent its withdrawal. The posts 56 are connected to the main body portion 34 of the latch plate 24, on the side of the latch plate opposite the handle portion 38. The posts 56 have enlarged heads 58. As shown in FIG. 5, the recess 40 extends all the way through the thickness of the shell wall 20 to the interior of the casket. The inner surface 60 of the shell wall 20 includes a countersunk region 62 which is greater in width and height than the recess 40. The posts 56 protrude from the recess 40 into the countersunk region 62. A pair of flexible washers 64 (only one of which is shown in FIG. 5) are snapped over the enlarged heads 58 of the posts 56, the washers residing within the countersunk region 62. The washers 64 prevent the latch plate 24 from being withdrawn from the recess 40.

The latch mechanism advantageously includes a detent feature which helps retain the latch plate 24 in the second or latched position indicated in FIG. 4B. To this end, the necked-down portion 54 of stud 22 includes a rib 70 on each of its opposite faces, and the narrow portion 50 of the slot 44 in latch plate 24 includes corresponding grooves 72 which the ribs 70 engage when the latch plate 24 is moved into the second position, as shown in FIG. 4B.

In use, the latch plate 24 is placed in the first position as shown in FIG. 4A, and the lid 16*a* is pivoted downward to a closed position with the lower edge 18 of the lid 16*a* abutting the upper edge 21 of the shell wall 20. When the lid 16*a* descends into the closed position, the projecting portion 28 of the stud 22 penetrates into the hole 46 in the upper edge 21, and the distal end 52 of the stud 22 engages the wide portion 48 of the slot 44 in the latch plate 24. With the lid 16*a* closed, the latch plate 24 is then slid into the second position as shown in FIG. 4B, which causes the narrow portion 50 of the slot 44 to engage the necked-down portion 54 of stud 22. The lid 16*a* is then securely latched closed. To open the lid again, the latch plate 24 is slid back into the first position, which permits the lid 16*a* to be opened.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. For example, although the latch mechanism has been illustrated as having the stud affixed to the lid and the latch plate affixed to the shell, the stud could as well be affixed to the shell and the latch plate affixed to the lid. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A latch mechanism for use with a casket including a shell having an upstanding wall terminating at an upper edge and a lid having a lower edge and wherein the upper and lower edges abut each other in face-to-face relationship when the casket is closed, said latch mechanism comprising:

a stud adapted to be secured within a vertical hole in the lid with a portion of said stud projecting downward from the lid lower edge and terminating at a distal end, said stud having a first width dimension adjacent said distal end and a necked-down portion of a second smaller width dimension spaced inward of said distal end; and a latch plate adapted to be secured within a transverse recess in the upstanding wall of the shell, said latch plate including an elongated keyhole-shaped slot which is adapted to be accessible through a vertical hole extending from the shell upper edge downward into the transverse recess, said slot having a wide portion sized to permit said distal end of said stud to pass through said latch plate, and a narrow portion sized to accommodate said necked-down portion and to prevent said distal end of said stud from passing through said latch plate, the latch plate being adapted to slide within the transverse recess between a first position in which said necked-down portion of said stud resides within said wide portion of said slot when the lid is closed, and a second position in which said necked-down portion resides within said narrow portion of said slot, whereby said latch plate, when in the second position, prevents the lid from being opened;

wherein said latch plate includes a main body portion including said slot and having a free end, a pair of posts connected to said free end and having enlarged heads, and a pair of snap-on washers each of which is connected to one of said posts, said latch plate in use being retained within the recess by said washers.

2. A latch mechanism for use with a casket including a shell having an upstanding wall terminating at an upper edge and a lid having a lower edge and wherein the upper and lower edges abut each other in face-to-face relationship when the casket is closed, said latch mechanism comprising:

a stud adapted to be secured within a vertical hole in the lid with a portion of said stud projecting downward from the lid lower edge and terminating at a distal end, said stud having a first width dimension adjacent said distal end and a necked-down portion of a second smaller width dimension spaced inward of said distal end; and a latch plate adapted to be secured within a transverse recess in the upstanding wall of the shell, said latch plate including an elongated keyhole-shaped slot which is adapted to be accessible through a vertical hole extending from the shell upper edge downward into the transverse recess, said slot having a wide portion sized to permit said distal end of said stud to pass through said latch plate, and a narrow portion sized to accommodate said necked-down portion and to prevent said distal end of said stud from passing through said latch plate, the latch plate being adapted to slide within the transverse recess between a first position in which said necked-down portion of said stud resides within said wide portion of said slot when the lid is closed, and a second position in which said necked-down portion resides within said narrow portion of said slot, whereby said latch plate, when in the second position, prevents the lid from being opened;

wherein said slot has two inner opposing surfaces, each of said opposing surfaces having an indentation therein in said narrow portion of said slot, and said necked-down portion of said stud has opposite faces which confront said opposing surfaces of said slot, each face having a protuberance thereon adapted to engage said indentations in said opposing surfaces of said slot when said latch plate is in said second position.

3. A combination of a casket and a latch mechanism, said combination comprising:

said casket having a shell and a lid, said shell including an upstanding wall which terminates at an upper edge, said lid including a lower edge which abuts said shell upper edge in face-to-face relationship when said lid is in a closed position on said shell, said lid lower edge including a vertical hole therein, said shell including a vertical hole therein which is aligned with said hole in said lid lower edge when said lid is closed, said upstanding wall of said shell including a transverse recess in communication with said hole in said shell upper edge; and said latch mechanism including:

a stud secured within said hole in said lid lower edge with a portion of said stud projecting downward therefrom and terminating at a distal end, said stud having a first width dimension adjacent said distal end and a necked-down portion of a second smaller width dimension spaced inward of said distal end; and a latch plate secured within said transverse recess, said latch plate including an elongated keyhole-shaped slot which is accessible through said hole in said shell upper edge, said slot having a wide portion sized to permit said distal end of said stud to pass through said latch plate, and a narrow portion sized to accommodate said necked-down portion and to prevent the distal end of said stud from passing through said latch plate, said latch plate being slidable within said transverse recess between a first position in which said necked-down portion of said stud resides within said wide portion of said slot when said lid is closed, and a second position in which said necked-down portion resides within said narrow portion of the slot, whereby said latch plate when it is in said second position prevents said lid from being opened.

4. The combination of claim 3, wherein said transverse recess extends through said shell wall from an outer surface thereof to an inner surface thereof, and said latch plate includes at least one post connected to a free end of said latch plate adjacent said inner surface, and a connector attached to said at least one post, said connector engaging said inner surface to prevent said latch plate from being withdrawn from said recess from outside said casket.

5. The combination of claim 3, wherein said stud and said latch plate are constructed of a combustible material.

6. The combination of claim 5, wherein said combustible material is plastic.

7. The combination of claim 3, wherein said latch plate includes a main body portion including said slot and having opposite side edges and a free end, and a flange portion connected to said main body portion and extending beyond said side edges of said main body portion, said flange portion abutting an outer surface of said shell wall when said latch plate is in use.

8. The combination of claim 7, said latch plate further includes a handle portion connected to said flange portion and adapted to be grasped by a user when sliding said latch plate between said first and second positions.

9. The combination of claim 3, wherein said latch plate includes a main body portion including said slot and having a free end, a pair of posts connected to said free end and having enlarged heads, and a pair of snap-on washers each of which is connected to one of said posts, said latch plate in use being retained within said recess by said washers.

10. The combination of claim 3, wherein said slot has two inner opposing surfaces, each of said opposing surfaces having an indentation therein in said narrow portion of said slot, and said necked-down portion of said stud has opposite faces which confront said opposing surfaces of said slot, each face having a protuberance thereon adapted to engage said indentations in said opposing surfaces of said slot when said latch plate is in said second position.

11. The combination of claim 3, wherein said stud is press-fit in said hole in said lid lower edge, said stud having an outer surface adjacent a proximal end of said stud opposite said distal end, said outer surface including circumferential ribs for engaging an inner surface of said hole in said lower edge.

12. A combination of a casket and a latch mechanism, said combination comprising:

said casket having a shell and a lid, said shell including an upstanding wall which terminates at an upper edge, said lid including a depending wall terminating at a lower edge which abuts said shell upper edge in face-to-face relationship when said lid is in a closed position on said shell; and said latch mechanism including a stud secured to one of said lid lower edge and said shell upper edge with a portion of said stud projecting outward therefrom and terminating at a distal end, said stud having a first width dimension adjacent said distal end and a necked-down portion of a second smaller width dimension spaced inward of said distal end; and a latch plate secured to the other of said lid lower edge and said shell upper edge, said latch plate including an elongated keyhole-shaped slot which is accessible to said projecting portion of said stud, said slot having a wide portion sized to permit said distal end of said stud to pass through said latch plate, and a narrow portion sized to accommodate said necked-down portion and to prevent the distal end of said stud from passing through said latch plate, said latch plate being slidable with respect to said stud between a first position in which said necked-down portion of said stud resides within said wide portion of said slot when said lid is closed, and a second position in which said necked-down portion resides within said narrow portion of the slot, whereby said latch plate when it is in said second position prevents said lid from being opened;

wherein said slot has two inner opposing surfaces, each of said opposing surfaces having an indentation therein in said narrow portion of said slot, and said necked-down portion of said stud has opposite faces which confront said opposing surfaces of said slot, each face having a protuberance thereon adapted to engage said indentations in said opposing surfaces of said slot when said latch plate is in said second position.

* * * * *